US007924229B2

(12) United States Patent
Shibata et al.

(10) Patent No.: US 7,924,229 B2
(45) Date of Patent: Apr. 12, 2011

(54) ANTENNA APPARATUS AND METHOD FOR ADJUSTING CHARACTERISTICS THEREOF

(75) Inventors: Tetsuya Shibata, Tokyo (JP); Yasumasa Harihara, Tokyo (JP); Hideaki Shimoda, Tokyo (JP)

(73) Assignee: TDK Corporation, Tokyo (JP)

( * ) Notice: Subject to any disclaimer, the term of this patent is extended or adjusted under 35 U.S.C. 154(b) by 379 days.

(21) Appl. No.: 12/236,619

(22) Filed: Sep. 24, 2008

(65) Prior Publication Data

US 2009/0079651 A1 Mar. 26, 2009

(30) Foreign Application Priority Data

Sep. 26, 2007 (JP) ..... 2007-249846

(51) Int. Cl.
*H01Q 1/38* (2006.01)

(52) U.S. Cl. ..... 343/700 MS; 343/702; 343/860

(58) Field of Classification Search ..... 343/700 MS, 343/702, 860

See application file for complete search history.

(56) References Cited

U.S. PATENT DOCUMENTS

| | | | | |
|---|---|---|---|---|
| 7,034,752 | B2 * | 4/2006 | Sekiguchi et al. | 343/700 MS |
| 7,319,431 | B2 * | 1/2008 | Jeon et al. | 343/700 MS |
| 2002/0190907 | A1 * | 12/2002 | Konishi et al. | 343/702 |
| 2004/0113846 | A1 * | 6/2004 | Achim | 343/700 MS |

FOREIGN PATENT DOCUMENTS

| | | |
|---|---|---|
| JP | 10-256825 | 9/1998 |
| JP | 2007-067993 | 3/2007 |

* cited by examiner

*Primary Examiner* — Douglas W Owens
*Assistant Examiner* — Dieu Hien T Duong
(74) *Attorney, Agent, or Firm* — Young Law Firm, P.C.

(57) ABSTRACT

An antenna apparatus includes an antenna block and a substrate. The antenna block has a base that is made of a substantially cuboid dielectric body, an upper-surface conductor formed on an upper surface of the base, first and second pad electrodes that are formed on both ends of a bottom surface of the base in a longitudinal direction of the base, respectively, and a lateral-surface conductor connecting the upper-surface conductor and the second pad electrode. The substrate has a region mounting the antenna block, a ground pattern provided around the mounting region, first and second lands that are provided within the mounting region so as to correspond to the positions of the first and second pad electrodes, a feed line that is connected to the first land, an impedance-adjusting pattern connecting the first land and the ground pattern, and a frequency-adjusting pattern connecting the second land and the ground pattern.

12 Claims, 11 Drawing Sheets

ANTENNA APPARATUS AND METHOD FOR ADJUSTING CHARACTERISTICS THEREOF

CROSS REFERENCE TO RELATED APPLICATIONS

This application claims the foreign priority under 35 U.S.C. §119(a)-(d) of Japanese Patent Application No. 2007-249846, filed Sep. 26, 2007, which application is hereby incorporated herein by reference in its entirety.

TECHNICAL FIELD

The present invention relates to an antenna apparatus and in particular relates to the structure of a conductor pattern of a surface-mount antenna that is housed within a cellular phone or the like and that is preferably used as a Bluetooth or GPS antenna. The present invention also relates to a method for adjusting characteristics, in which the impedance or resonant frequency of such an antenna apparatus is adjusted.

BACKGROUND OF THE INVENTION

The resonant frequency and impedance of a chip antenna housed in a cellular phone or other small portable terminal changes due to the effects of the housing, the various electrical components mounted in the vicinity, and the structure of the substrate. Adjusting the impedance and resonant frequency of this type of chip antenna is therefore necessary for each small portable terminal model.

In, e.g., Japanese Laid-open Patent Application No. 2007-67993, a method is proposed in which the resonant frequency is adjusted by changing the length of an adjusting element provided on the base. According to this method, the resonant frequency can be adjusted without trimming the conductor pattern on the antenna block, and therefore chip antennas having the same structure can be used in a plurality of small portable terminal models, and components can be shared.

In Japanese Laid-open Patent Application No. 10-256825, a method is proposed in which the resonant frequency and impedance are adjusted by trimming the antenna electrode. According to this method, not just the resonant frequency but the impedance of the antenna can be adjusted.

SUMMARY OF THE INVENTION

However, in the antenna apparatus described in Japanese Laid-open Patent Application No. 2007-67993, the resonant frequency can be adjusted, but the impedance of the antenna cannot be adjusted. In the antenna apparatus in Japanese Laid-open patent application Ser. No. 10-256825, the antenna electrode itself must be trimmed, and problems are therefore presented in the complexity of the steps. In particular, a gap is provided between the emitting electrode and the ground electrode, and the emitting electrode and the ground electrode are trimmed, whereby the capacitance component resulting from the gap is adjusted; however, the antenna characteristics are highly responsive to adjustments made to the gap, and the resonant frequency and the impedance therefore cannot be adjusted independently. Problems are therefore presented in that the actual adjustment is difficult, and the antenna characteristics readily fluctuate.

It is therefore an object of the present invention to independently adjust the resonant frequency and the impedance and thereby provide an antenna apparatus that can be used in small portable terminals of a variety of models.

Another object of the present invention is to provide a method for adjusting the impedance or the resonant frequency of the antenna apparatus.

The above and other object of the present invention can be accomplished by an antenna apparatus of the present invention comprises an antenna block and a substrate upon which the antenna block is mounted, wherein the antenna block has a base that is made of a substantially cuboid dielectric body or magnetic body, an upper-surface conductor formed on an upper surface of the base, first and second pad electrodes that are formed on both ends of a bottom surface of the base in a longitudinal direction of the base, respectively, and a lateral-surface conductor connecting the upper-surface conductor and the second pad electrode; and the substrate has a region mounting the antenna block, a ground pattern provided around the mounting region, first and second lands that are provided within the mounting region so as to correspond to the positions of the first and second pad electrodes, a feed line that is connected to the first land, an impedance-adjusting pattern connecting the first land and the ground pattern, and a frequency-adjusting pattern connecting the second land and the ground pattern.

According to the present invention, the impedance-adjusting pattern and the frequency-adjusting pattern are provided on the substrate. The impedance and resonant frequency of the antenna can therefore be adjusted without, e.g., trimming the conductor pattern on the antenna block. The resonant frequency does not substantially change even when the impedance is adjusted using the impedance-adjusting pattern, and the impedance does not substantially change when the resonant frequency is adjusted using the frequency-adjusting pattern. The impedance and the resonant frequency can therefore be adjusted independently, and the adjustment operation is facilitated.

Antenna blocks having the same structure can thereby be used in a plurality of small portable terminal models, the cost of components can be reduced, and the efficiency of the antenna design can be improved.

The antenna apparatus of the present invention preferably further comprises an impedance-adjusting element mounted on the substrate and connecting the feed line and the ground pattern. The impedance that is roughly adjusted by the impedance-adjusting pattern can thereby be finely adjusted by the impedance-adjusting element.

The antenna block of the present invention preferably further comprises a third pad electrode provided to a center part of the bottom surface of the base in the longitudinal direction, and the substrate further comprises a third land that is provided within the mounting region so as to correspond to the position of the third pad electrode. The resonant frequency of the antenna apparatus can accordingly be changed by the capacitive coupling of the third pad electrode and the upper-surface conductor.

The antenna block of the present invention preferably further comprises a frequency-adjusting element mounted on the substrate and connecting the third land and the ground pattern. The resonant frequency that is roughly adjusted by the frequency-adjusting pattern can thereby be finely adjusted by the frequency-adjusting element.

The antenna apparatus of the present invention preferably comprises a plurality of the impedance-adjusting pattern. Accordingly, the impedance can be more finely adjusted by trimming one or more of the plurality of the impedance-adjusting pattern.

The antenna apparatus of the present invention preferably also comprises a slit provided in the ground-pattern and extending from a space provided between the plurality of the impedance-adjusting pattern. The antenna apparatus of the present invention preferably comprises a plurality of the slit, lengths of the plurality of the slit being all different. Larger changes in characteristics are thereby possible in comparison to changing the width of the impedance-adjusting pattern.

The antenna apparatus of the present invention preferably comprises a plurality of the frequency-adjusting pattern. Accordingly, the resonant frequency can be more finely adjusted by trimming one or more of the plurality of the frequency-adjusting pattern.

The antenna apparatus of the present invention preferably also comprises a slit provided in the ground-pattern and extending from a space provided between the plurality of the frequency-adjusting pattern. The antenna apparatus of the present invention preferably comprises a plurality of the slit, lengths of the plurality of the slit being all different. Larger changes in characteristics are thereby possible in comparison to changing the width of the plurality of the frequency-adjusting pattern.

The above and other object of the present invention can also be accomplished by a method for adjusting characteristics of the above antenna apparatus according to the present invention comprising the steps of preparing the substrate on which the impedance-adjusting pattern having a prescribed shape and size is formed and mounting the antenna block on the mounting region; measuring an impedance of the antenna block on the substrate; and selecting the impedance-adjusting element having an appropriate constant on the basis of the measurement results and mounting the impedance-adjusting element on a prescribed location on the substrate.

According to the present invention, the impedance of an antenna can be adjusted without, e.g., trimming the conductor pattern on the antenna block. Antenna blocks having the same structure can therefore be used in a plurality of small portable terminal models, the cost of components can be reduced, and the efficiency of the antenna design can be improved.

The above and other object of the present invention can also be accomplished by a method for adjusting characteristics of the above antenna apparatus according to the present invention comprising the steps of preparing the substrate on which the frequency-adjusting pattern having a prescribed shape and size is formed and mounting the antenna block on the mounting region; measuring a frequency of the antenna block on the substrate; and selecting the frequency-adjusting element having an appropriate constant on the basis of the measurement results and mounting the frequency-adjusting element on a prescribed location on the substrate.

According to the present invention, the resonant frequency of an antenna can be adjusted without, e.g., trimming the conductor pattern on the antenna block. Antenna blocks having the same structure can therefore be used in a plurality of small portable terminal models, the cost of components can be reduced, and the efficiency of the antenna design can be improved.

BRIEF DESCRIPTION OF THE DRAWINGS

The above features and advantages of the present invention will be more apparent from the following description of certain preferred embodiments taken in conjunction with the accompanying drawings, wherein.

DESCRIPTION OF THE PREFERRED EMBODIMENTS

Preferred embodiments of the present invention will be described in detail hereinafter with reference to the accompanying drawings.

Figure 1:
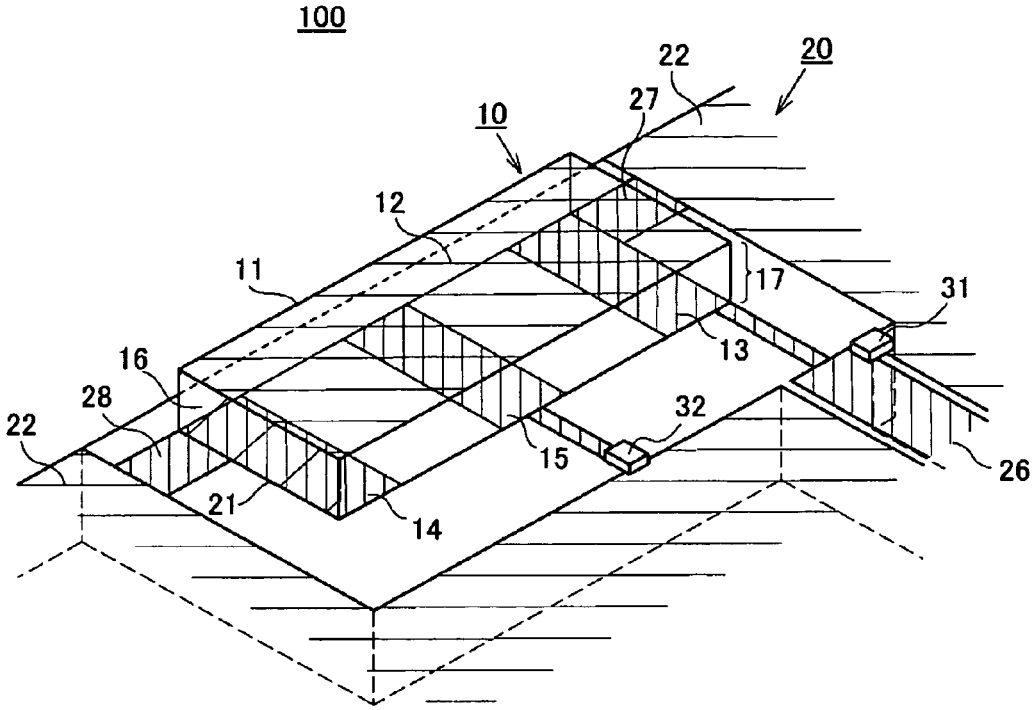
FIG. 1 is a schematic disassembled perspective view that shows the configuration of an antenna apparatus according to a first embodiment of the present invention.
Figure 2:
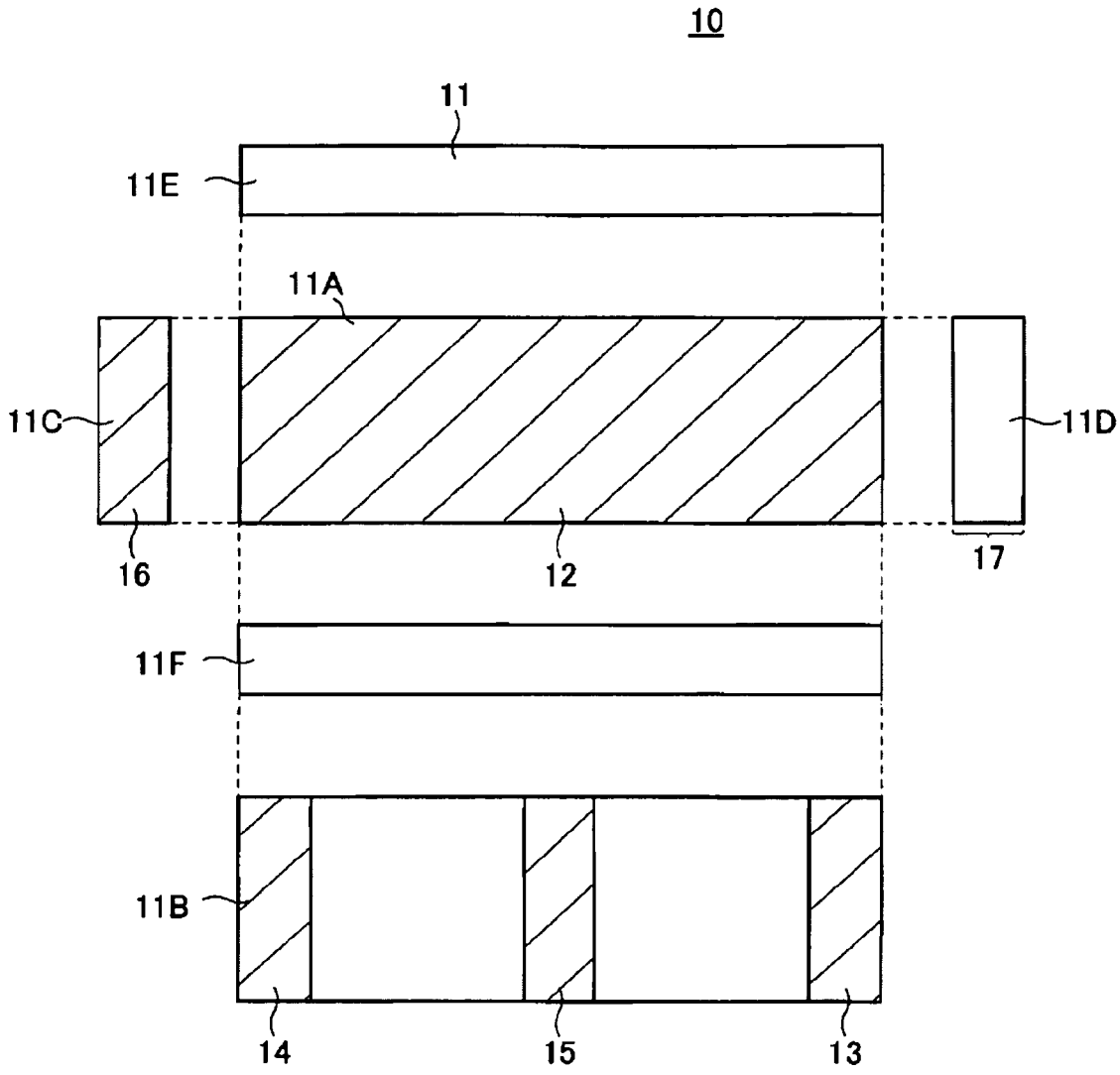
FIG. 2 is a development view of the antenna block shown in FIG. 1.

FIG. 1 is a schematic disassembled perspective view that shows the configuration of an antenna apparatus according to a first embodiment of the present invention. FIG. 2 is a development view of the antenna block shown in FIG. 1.

As shown in FIGS. 1 and 2, an antenna apparatus 100 is provided with an antenna block 10 and a substrate 20 on which this antenna block 10 is mounted.

The antenna block 10 is provided with a base 11 composed of a cuboid dielectric body, an upper-surface conductor 12 formed over substantially the entire surface of the upper surface 11A of the base 11, first through third pad electrodes 13 through 15 that are formed on the bottom surface 11B of the base 11, and a lateral-surface conductor 16 that is formed over substantially the entire surface of a first lateral surface 11C that is perpendicular to the longitudinal direction of the base 11. The conductor pattern is not formed on a second lateral surface 11D that faces the first lateral surface 11C or on third and fourth lateral surfaces 11E, 11F that are parallel to the longitudinal direction of the base 11.

One end of the upper-surface conductor 12 in the longitudinal direction constitutes an open end but is substantially connected to the first pad electrode 13 through a gap 17 that is equal to the height of the base 11. The other end of the upper-surface conductor 12 in the longitudinal direction is connected to the second pad electrode 14 through the lateral-surface conductor 16. The first pad electrode 13, the gap 17, the upper-surface conductor 12, and the lateral-surface conductor 16 are thereby configured as a single continuous radiation conductor. The radiation conductor is thus formed over a plurality of the surfaces of the base 11, and therefore the desired electrical length can be ensured while reducing the size of the base 11 itself.

The first and second pad electrodes 13, 14 are rectangular patterns and are formed on both ends of the bottom surface 11B of the base 11 in the longitudinal direction of the base 11, respectively. The third pad electrode 15 is formed in the central part of the bottom surface 11B of the base 11 in the longitudinal direction and is provided between the first and second pad electrodes 13, 14. The conductor patterns formed on the surfaces of the base 11 is preferably formed to be as symmetrical as possible. The shape of the conductor pattern on the antenna block 10 as seen from the end of the substrate 20 will thereby be the same even if the antenna block 10 is horizontally inverted. The antenna characteristics will therefore not change greatly due to the orientation of mounting, and antenna design can be facilitated.

Figure 3:
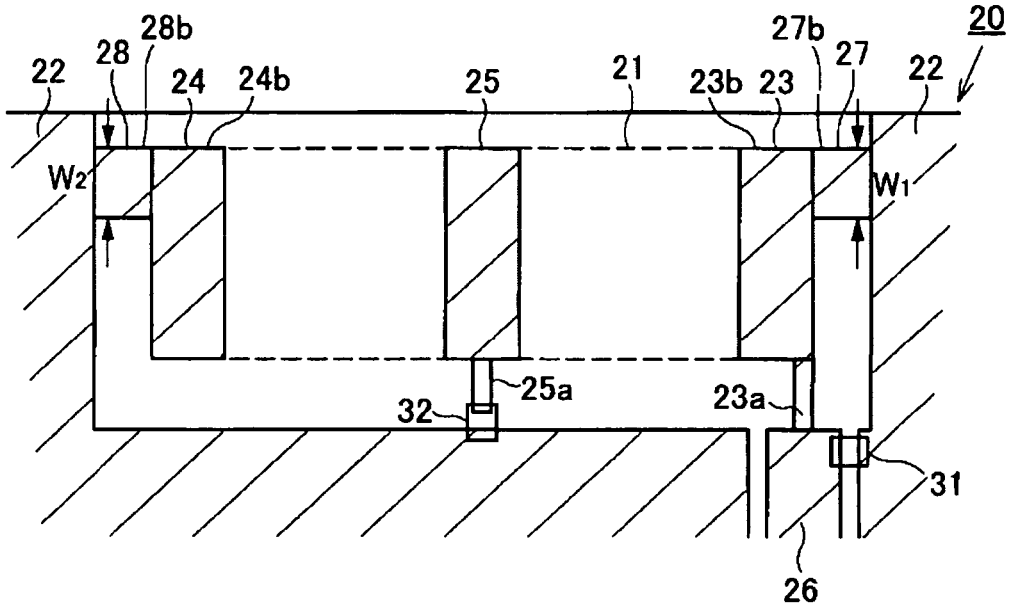
FIG. 3 is a schematic plan view that shows the configuration of the substrate 20.

FIG. 3 is a schematic plan view that shows the configuration of the substrate 20.

As shown in FIGS. 1 and 3, the substrate 20 is provided with a mounting region 21 for the antenna block 10, a ground pattern 22 provided around the mounting region 21, first through third lands 23 through 25 provided within the mounting region 21, a feed line 26 connected to the first land 23, an impedance-adjusting pattern 27 connecting the first land 23 and the ground pattern 22, and a frequency-adjusting pattern 28 connecting the second land 24 and the ground pattern 22.

The mounting region 21 is provided along the end of the substrate 20. Three sides of the mounting region 21 are therefore surrounded by the ground pattern 22, but the remaining side is an open space that is not present on the base. The ground pattern 22 is formed not only on the front surface of the substrate 20 but also on the reverse surface, though a clearance region on which the ground pattern is not formed is present on at least a portion of the reverse side of the mounting region 21.

The first land 23 within the mounting region 21 corresponds to the first pad electrode 13 of the antenna block 10, the second land 24 corresponds to the second pad electrode 14, and the third land 25 corresponds to the third pad electrode 15. When the antenna block 10 is mounted on the substrate 20, the first pad electrode 13 is therefore connected by soldering to the first land 23, the second pad electrode 14 is connected by soldering to the second land 24, and the third pad electrode 15 is connected by soldering to the third land.

The feed line 26 is connected to a lead portion 23*a* of the first land 23. A chip reactor 31 that acts as an impedance-adjusting element is mounted between the feed line 26 and the ground pattern 22. The width of the lead portion 23*a* is preferably significantly narrower than the feed line 26. The location for mounting the chip reactor 31 is outside the clearance region that includes the mounting region 21 and is preferably as close as possible to the clearance region.

A chip reactor 32 that acts as a frequency-adjusting element is mounted between the third land 25 and the ground pattern 22. The chip reactor 32 is inserted in series between a lead portion 25*a* of the third land 25 and the ground pattern 22. The location for mounting the chip reactor 32 is within the clearance region that includes the mounting region 21 and is preferably as close as possible to the ground pattern 22.

The impedance-adjusting pattern 27 is provided between the first land 23 and the ground pattern 22. The impedance-adjusting pattern 27 of the present embodiment has a rectangular shape. A side 27*b* of the impedance-adjusting pattern 27 positioned on the end of the base and a side 23*b* of the first land 23 positioned on the end of the base are positioned on the same line. Adjustment of the impedance of the antenna can be performed by changing a width $W_1$ of the impedance-adjusting pattern 27.

The frequency-adjusting pattern 28 is provided between the second land 24 and the ground pattern 22. The frequency-adjusting pattern 28 of the present embodiment has a rectangular shape. A side 28*b* of the frequency-adjusting pattern 28 positioned on the end of the base and a side 24*b* of the second land 24 positioned on the end of the base are positioned on the same line. Adjustment of the resonant frequency of the antenna can be performed by changing a width $W_2$ of the frequency-adjusting pattern 28.

Figure 4A:
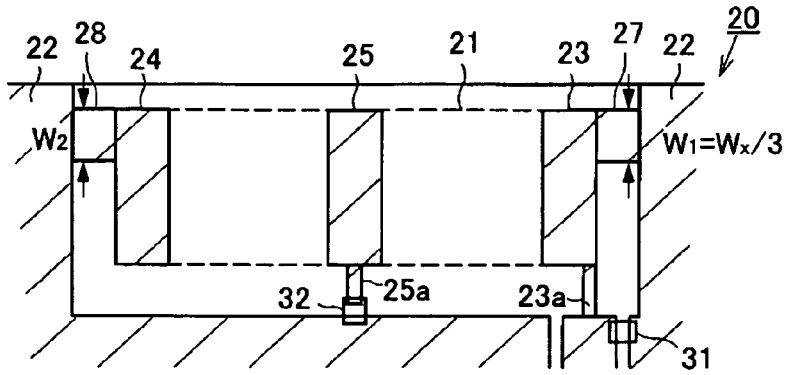
FIGS. 4A to 4C are plan views that show modified examples of the impedance-adjusting pattern.
Figure 4B:
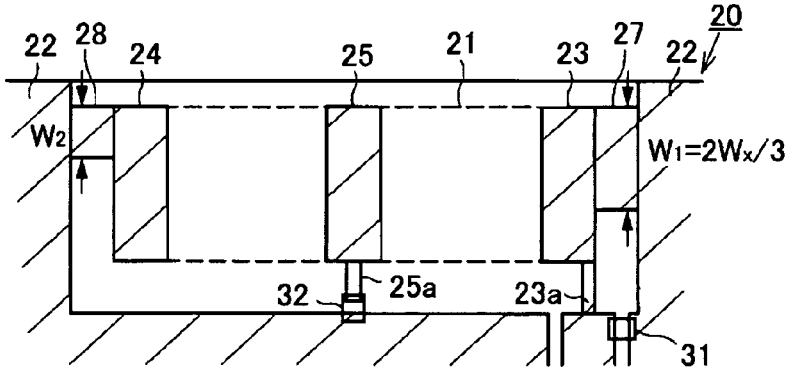
Figure 4C:
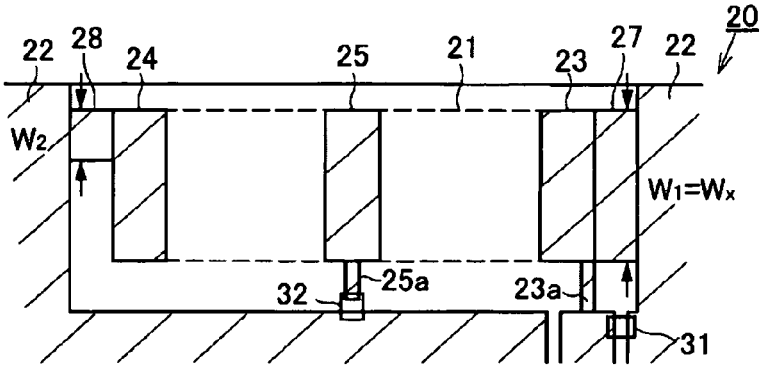

FIGS. 4A to 4C are plan views that show modified examples of the impedance-adjusting pattern.

The impedance of the antenna apparatus 100 can be adjusted by changing the width $W_1$ of the impedance-adjusting pattern 27, as shown in FIGS. 4A through 4C. In FIG. 4A, the width $W_1$ of the impedance-adjusting pattern 27 is set to one third of a width Wx of the first land 23 ($W_1=W_x/3$). In FIG. 4B, $W_1$ is set to equal two thirds of Wx ($W_1=2W_x/3$). In FIG. 4C, $W_1$ is set to equal Wx ($W_1=W_x$). The impedance of the antenna apparatus 100 decreases as the width $W_1$ of the impedance-adjusting pattern 27 increases, and therefore the impedance of the antenna apparatus shown in FIG. 4A is the largest, and the impedance of the antenna apparatus shown in FIG. 4C is the smallest. The width $W_1$ of the impedance-adjusting pattern 27 is therefore set to an appropriate value, whereby the impedance can be roughly adjusted.

On the other hand, the resonant frequency of the antenna apparatus 100 does not substantially change even when the width $W_1$ of the impedance-adjusting pattern 27 is changed. In other words, the impedance alone can be independently adjusted using the impedance-adjusting pattern 27.

The impedance of the antenna apparatus 100 can be roughly adjusted at the design stage by forming an impedance-adjusting pattern having a prescribed size, but further adjustment can be performed by laser-trimming the impedance-adjusting pattern that was set to a prescribed width in advance. Depending on the circumstances, the impedance-adjusting pattern 27 may also be put in an open state without being grounded to the ground pattern 22. Significant impedance adjustments are possible in such instances.

After the antenna impedance has been thus roughly adjusted by the impedance-adjusting pattern, the impedance of the antenna block is measured. The constant of the chip reactor 31, which acts as an impedance-adjusting element, is selected appropriately on the basis of the measurement results, whereby the antenna impedance can be finely adjusted.

Figure 5A:
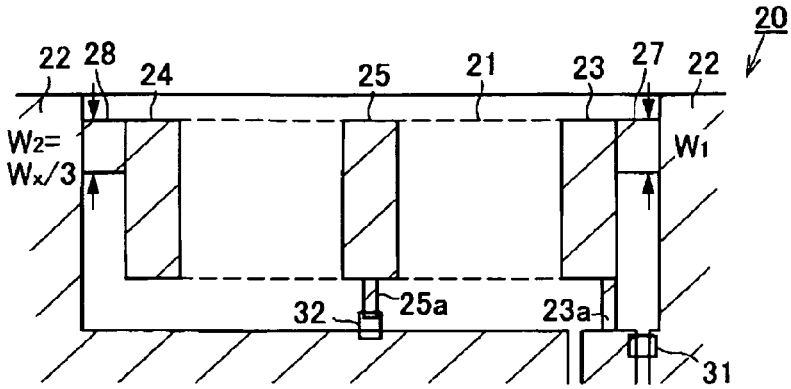
FIGS. 5A to 5C are plan views that show modified examples of the frequency-adjusting pattern.
Figure 5B:
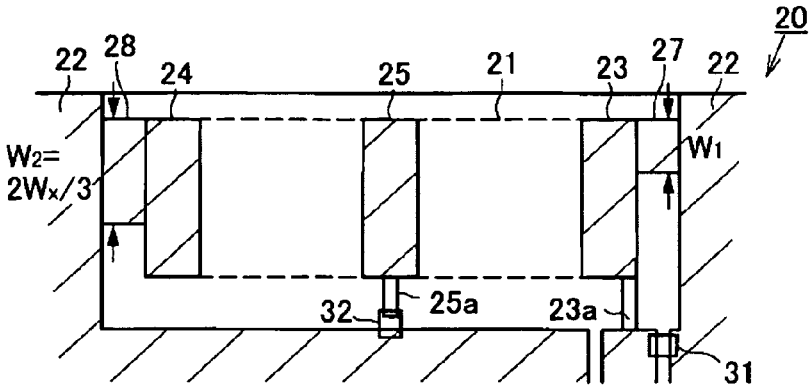
Figure 5C:
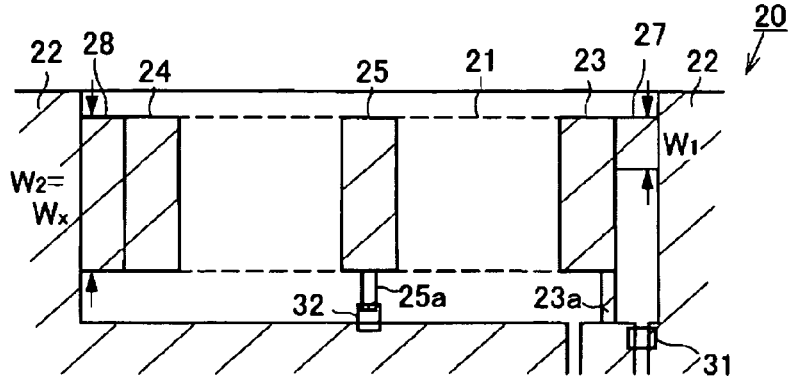

FIGS. 5A to 5C are plan views that show modified examples of the frequency-adjusting pattern.

The resonant frequency of the antenna apparatus 100 can be adjusted by changing the width $W_2$ of the frequency-adjusting pattern 28, as shown in FIGS. 5A through 5C. In FIG. 5A, the width $W_2$ of the frequency-adjusting pattern 28 is set to one third of a width Wx of the second land 24 ($W_2=W_x/3$). In FIG. 5B, $W_2$ is set to equal two thirds of Wx ($W_2=2W_x/3$). In FIG. 5C, $W_2$ is set to equal Wx ($W_2=W_x$). The resonant frequency of the antenna apparatus 100 increases as the width $W_2$ of the frequency-adjusting pattern 28 increases, and therefore the resonant frequency of the antenna apparatus shown in FIG. 5A is the smallest, and the resonant frequency of the antenna apparatus shown in FIG. 5C is the largest. The width $W_2$ of the frequency-adjusting pattern 28 is therefore set to an appropriate value, whereby the resonant frequency can be roughly adjusted.

On the other hand, the impedance of the antenna apparatus 100 does not substantially change even when the width $W_2$ of the frequency-adjusting pattern 28 is changed. In other words, the resonant frequency alone can be independently adjusted using the frequency-adjusting pattern 28.

The resonant frequency of the antenna apparatus 100 can be roughly adjusted at the design stage by forming a frequency-adjusting pattern having a prescribed size, but further adjustment can be performed by laser-trimming the frequency-adjusting pattern that was set to a prescribed width in advance. Depending on the circumstances, the frequency-adjusting pattern 28 may also be put in an open state without being grounded to the ground pattern 22. Significant resonant-frequency adjustments are possible in such instances.

After the resonant frequency of the antenna has been thus roughly adjusted by the frequency-adjusting pattern, the resonant frequency of the antenna block is measured. The constant of the chip reactor 32, which acts as a frequency-adjusting element, is selected appropriately on the basis of the measurement results, whereby the resonant frequency of the antenna can be finely adjusted.

The antenna apparatus 100 of the present embodiment is provided with the impedance-adjusting pattern 27 that connects the first land 23 and the ground pattern 22, as described above. The impedance of the antenna can therefore be roughly adjusted without, e.g., trimming the conductor pattern on the antenna block 10. According to the present embodiment, the impedance-adjusting element (chip reactor) 31 that connects the feed line 26 and the ground pattern 22 in parallel is also provided. The impedance of the antenna can therefore be finely adjusted by employing an appropriate element value.

The antenna apparatus 100 of the present embodiment is further provided with the frequency-adjusting pattern 28 that connects the second land 24 and the ground pattern 22. The resonant frequency of the antenna can therefore be roughly adjusted without, e.g., trimming the conductor pattern on the antenna block 10. According to the present embodiment, the frequency-adjusting element (chip reactor) 32 that connects the third land 25 and the ground pattern 22 is also provided. The resonant frequency of the antenna can therefore be finely adjusted by employing an appropriate element value.

The resonant frequency does not substantially change even when the impedance is adjusted using the impedance-adjusting pattern 27, and the impedance does not substantially change when the resonant frequency is adjusted using the frequency-adjusting pattern 28. The impedance and the resonant frequency can therefore be adjusted independently. In other words, the one has substantially no effect on the other, and adjustment can therefore be readily performed.

According to the antenna apparatus 100 of the present embodiment, the impedance-adjusting means, which is made of the impedance-adjusting pattern 27 and the impedance-adjusting element 31, and the frequency-adjusting means, which is made of the frequency-adjusting pattern 28 and the frequency-adjusting element 32, are both provided separately and independently on the substrate 20. Antenna blocks 10 having the same structure can therefore be used in a plurality of small portable terminal models, the cost of components can be reduced, and the efficiency of the antenna design can be improved.

In the above antenna apparatus 100, the impedance or the resonant frequency is adjusted by changing the size of one impedance-adjusting pattern or one frequency-adjusting pattern, but these characteristics can also be adjusted by changing the number of patterns. The shape of the pattern is also not limited to a rectangle. Tapered shapes, stepped shapes, slit shapes, and a variety of other shapes may also be employed.

Figure 6:
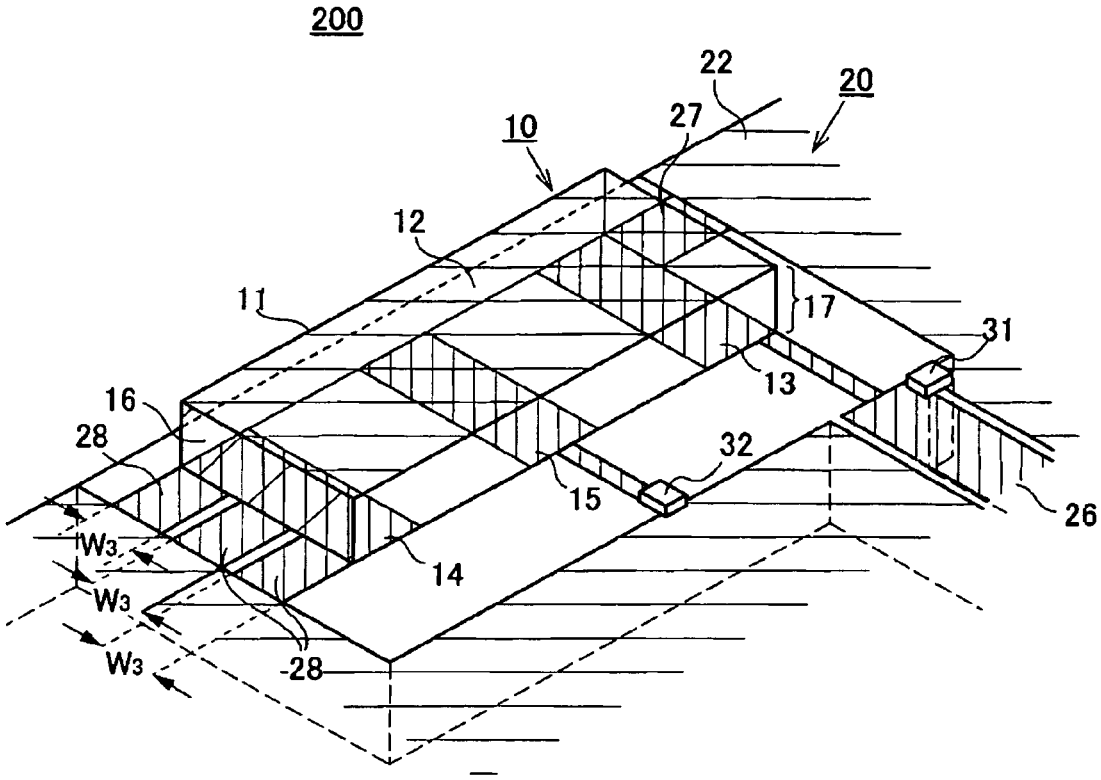
FIG. 6 is a schematic perspective view that shows the configuration of an antenna apparatus according to a second embodiment of the present invention.

FIG. 6 is a schematic perspective view that shows the configuration of an antenna apparatus according to a second embodiment of the present invention.

As shown in FIG. 6, this antenna apparatus 200 is characterized in the use of a plurality (three in the present example) of the rectangular frequency-adjusting patterns 28, which have a set width $W_3$. The plurality of the frequency-adjusting patterns 28 are preferably all of equivalent size, and the pattern intervals are also preferably equivalent. A plurality of the impedance-adjusting patterns 27 may also be employed in the same manner as the frequency-adjusting patterns 28. Alternatively, only the impedance-adjusting patterns 27 may be formed in plurality. According to the present embodiment, the number and the width $W_3$ of the frequency-adjusting patterns 28 are set to appropriate values, whereby the resonant frequency can be roughly adjusted. The width and number of the impedance-adjusting patterns 27 are also set to appropriate values, whereby the impedance can be roughly adjusted.

A number of the above plurality of the impedance-adjusting patterns 27 may also be removed in a subsequent trimming step. The impedance of the antenna can thus be more finely adjusted by cutting a number of the plurality of the impedance-adjusting patterns 27.

Figure 7:
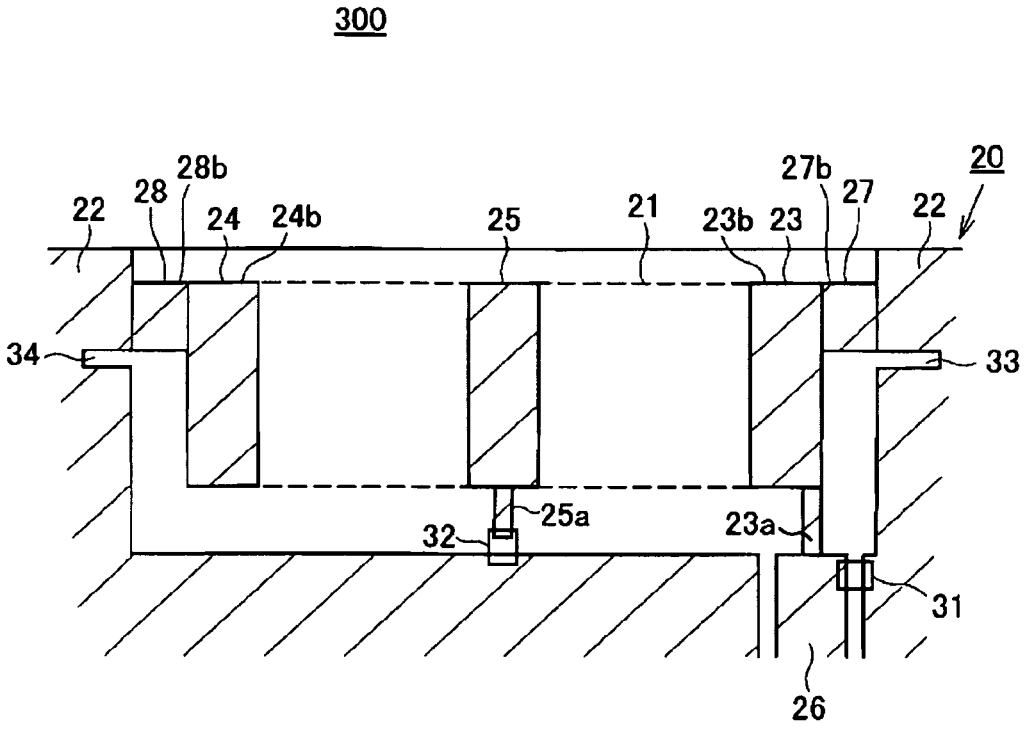
FIG. 7 is a schematic plan view that shows the configuration of the substrate of an antenna apparatus according to a third embodiment of the present invention.

FIG. 7 is a schematic plan view that shows the configuration of the substrate of an antenna apparatus according to a third embodiment of the present invention.

As shown in FIG. 7, this antenna apparatus 300 is characterized in being provided with an impedance-adjusting slit 33 and a frequency-adjusting slit 34 formed by cutting out a part of the ground pattern 22. The impedance-adjusting slit 33 is provided adjoining the impedance-adjusting pattern 27 and is extended parallel to the longitudinal direction of the base 11. The frequency-adjusting slit 34 is provided adjoining the frequency-adjusting pattern 28 and is extended parallel to the longitudinal direction of the base 11.

The slits 33, 34 maybe formed on the upper-surface side of the base or may be formed on both the upper-surface side and the lower-surface side. The length and width of the slits 33, 34 may be set appropriately according to the target antenna impedance and resonant frequency. When the impedance-adjusting slit 33 has been formed, the impedance can be increased to a greater extent than when narrowing the width of the impedance-adjusting pattern 27. When the frequency-adjusting slit 34 has been formed, the resonant frequency can be reduced to a greater extent than when narrowing the width of the frequency-adjusting pattern 28.

Figure 8:
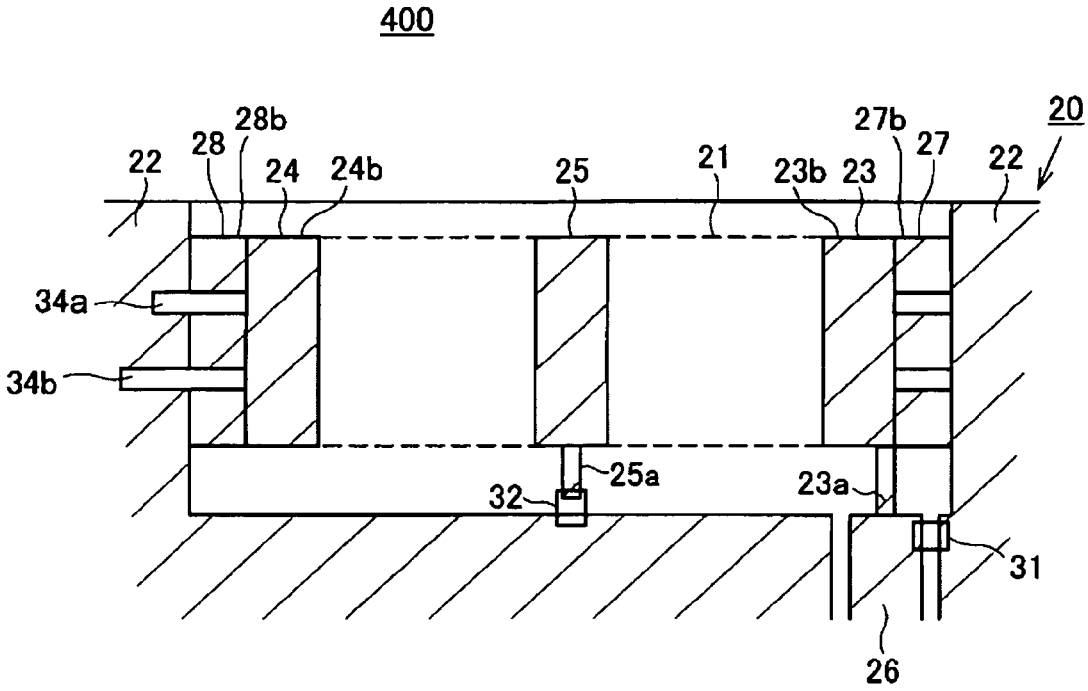
FIG. 8 is a schematic plan view that shows the configuration of the substrate of an antenna apparatus according to a fourth embodiment of the present invention.

FIG. 8 is a schematic plan view that shows the configuration of the substrate of an antenna apparatus according to a fourth embodiment of the present invention.

As shown in FIG. 8, this antenna apparatus 400 is characterized in that a plurality of slits 34*a*, 34*b* continuing from the spaces between the plurality of the frequency-adjusting patterns 28 are further provided. The lengths of these slits 34*a*, 34*b* are preferably non-uniform and not identical. The width for adjusting frequency can be more finely set by forming such slits 34*a*, 34*b*.

Figure 9:
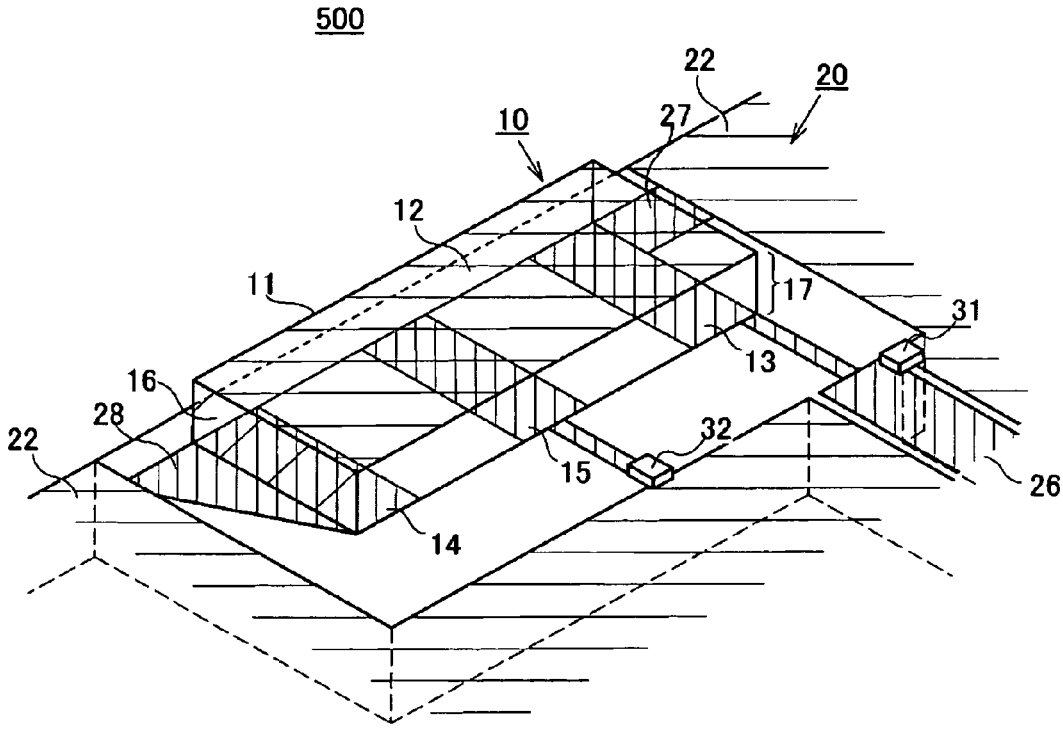
FIG. 9 is a schematic perspective view that shows the configuration of an antenna apparatus according to a fifth embodiment of the present invention.

FIG. 9 is a schematic perspective view that shows the configuration of an antenna apparatus according to a fifth embodiment of the present invention.

As shown in FIG. 9, this antenna apparatus 500 is characterized in the use of a tapered shape for the frequency-adjusting pattern 28. The impedance-adjusting pattern 27 may also be formed having a tapered shape in the same manner as the frequency-adjusting pattern 28. Alternatively, the impedance-adjusting pattern 27 alone may be formed having a tapered shape. According to the present embodiment, the angle of the taper of the impedance-adjusting pattern 27 or the frequency-adjusting pattern 28 is set as appropriate, whereby the impedance or the resonant frequency of the antenna can be roughly adjusted.

The present invention is not limited by the abovementioned embodiments. The present invention may be modified in various ways in a range that does not depart from the intended scope thereof, and it is apparent that such modifications are encompassed by the claims of the present invention.

For example, in the above embodiments, an example was given in which the antenna mounting region was surrounded by the ground pattern on three sides, but the mounting region may also be surrounded by the ground pattern on two sides or on only one side.

In the above embodiments, the width and length of the impedance-adjusting pattern and the frequency-adjusting pattern were adjusted, whereby the impedance and the resonant frequency were adjusted, but adjustment may also be performed by providing lumped-parameter elements (L, C) in series or in parallel with these patterns.

In the above embodiments, the base 11 was composed of a cuboid dielectric body, but a dielectric magnetic body may also be used instead of a dielectric body. An effect of $1/\sqrt{(\in\times\mu)}$ wavelength shortening is obtained in this instance, and therefore a large wavelength-shortening effect is. obtained by using a magnetic body having a high magnetic permeability $\mu$. Additionaly, $\mu/\in$ determines the impedance of the electrode, and therefore the impedance increases as a result of using a magnetic body having a high $\mu$. An excessively large Q for the antenna can thereby be reduced, and broadband characteristics can be obtained. The cuboid base 11 may be substantially cuboid, and, e.g., may be tapered in a corner region in order to identify the orientation of the cuboid.

In the above embodiments, the third pad electrode 15 and the third land 25 were provided, but the provision of these components is not essential to the present invention.

EXAMPLE 1

The antenna block 10 shown in FIGS. 1 and 2 was prepared. The dimensions of the base 11 of the antenna block 10 were 9×3×1 (mm).

This antenna block 10 was mounted on the substrate 20 shown in FIGS. 1 and 3. In the present example, the width $W_2$ of the frequency-adjusting pattern 28 was constant ($W_2$=1 mm). The impedance of the antenna was measured while the width $W_1$ of the impedance-adjusting pattern 27 was changed in three stages: $W_1$=Wx/3=1 mm, $W_1$=2Wx/3=2 mm, and $W_1$=Wx=3 mm. These three stages correspond to FIGS. 4A though 4C, respectively.

Figure 10A:
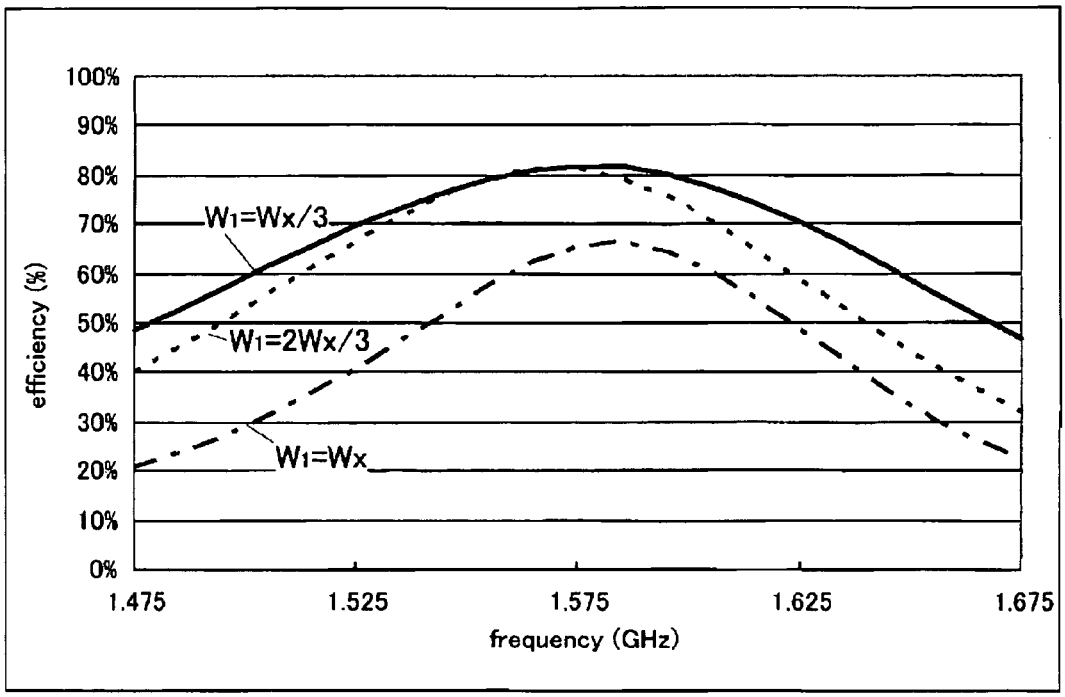
FIG. 10A is a graph that shows the relationship between a impedance-adjusting pattern and antenna efficiency.
Figure 10B:
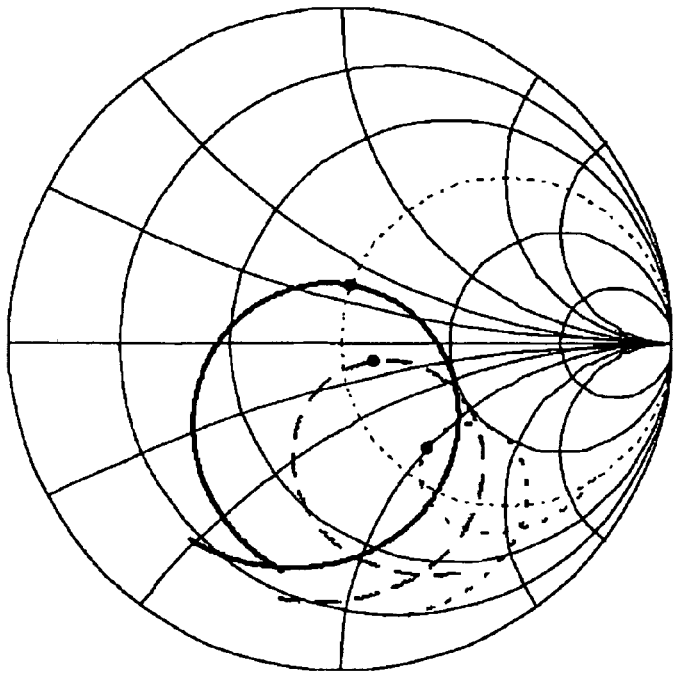
FIG. 10B is a Smith chart that shows the impedance characteristics of the antenna.

The measurement results are shown in FIG. 10. FIG. 10A is a graph that shows the antenna efficiency, where the horizontal axis displays the frequency (GHz), and the vertical axis displays the antenna efficiency (%). FIG. 10B is a Smith chart that shows the impedance characteristics of the antenna.

As shown in FIG. 10A, the antenna efficiency was approximately 83% when the width $W_1$ of the impedance-adjusting pattern 27 was 1 mm, approximately 81% when $W_1$=2 mm, and approximately 67% when $W_1$=3 mm. The impedance decreased as the width of the impedance-adjusting pattern 27 increased, as shown in FIG. 10B. On the other hand, the resonant frequency substantially did not change even when the width $W_1$ of the impedance-adjusting pattern 27 was changed.

The width $W_1$ of the impedance-adjusting pattern 27 was thereby changed, whereby it was confirmed that the impedance can be adjusted independently without the resonant frequency being substantially changed.

EXAMPLE 2

The same antenna block 10 used in Example 1 was prepared and was mounted on the substrate 20 shown in FIGS. 1 and 3. In the present example, the width $W_1$ of the impedance-adjusting pattern 27 was constant ($W_1$=1 mm). The resonant frequency of the antenna was measured while the width $W_2$ of the frequency-adjusting pattern 28 was changed in three stages: $W_2$=Wx/3=1 mm, $W_2$=2Wx/3=2 mm, and $W_2$=Wx=3 mm. These three stages correspond to FIGS. 5A though 5C, respectively.

Figure 11A:
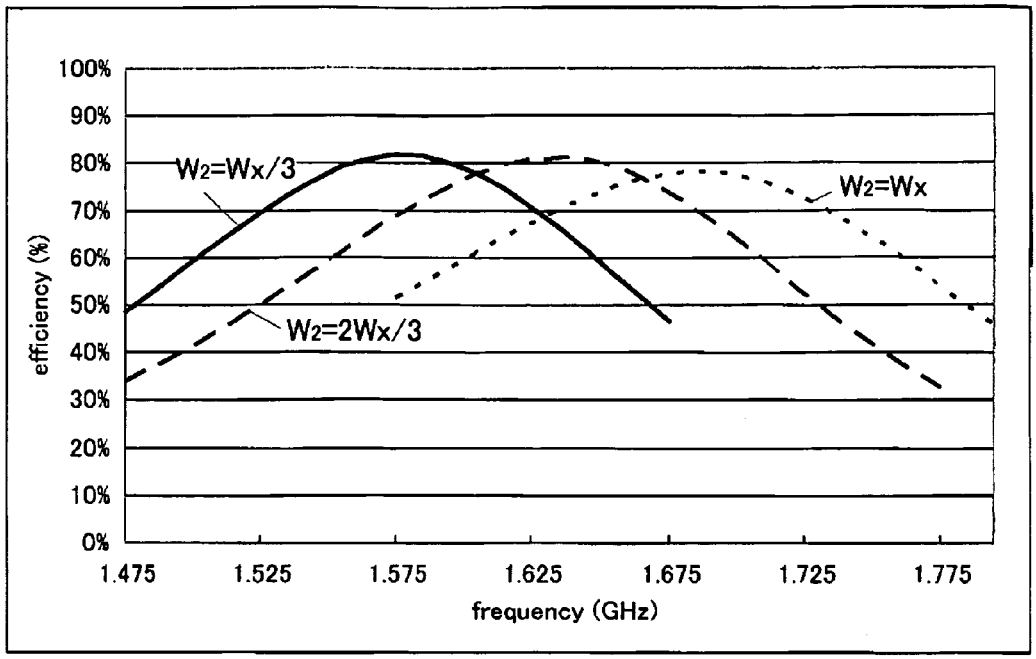
FIG. 11A is a graph that shows the relationship between a frequency-adjusting pattern and antenna efficiency.
Figure 11B:
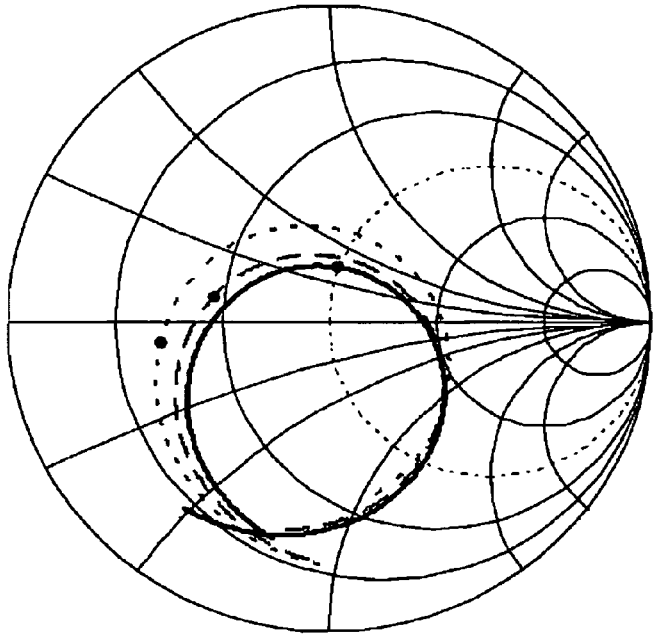
FIG. 11B is a Smith chart that shows the impedance characteristics of the antenna.

The measurement results are shown in FIG. 11. FIG. 11A is a graph that shows the antenna efficiency, where the horizontal axis displays the frequency (GHz), and the vertical axis displays the antenna efficiency (%). FIG. 11B is a Smith chart that shows the impedance characteristics of the antenna.

As shown in FIG. 11A, the resonant frequency was approximately 1.570 GHz when the width $W_2$ of the frequency-adjusting pattern 28 was 1 mm, approximately 1.630 GHz when $W_2$=2 mm, and approximately 1.680 GHz when $W_2$=3 mm. The resonant frequency increased as the width of the frequency-adjusting pattern increased, as shown in FIG. 11B. On the other hand, the impedance substantially did not change even when the width $W_2$ of the frequency-adjusting pattern 28 was changed.

The width $W_2$ of the frequency-adjusting pattern was thereby changed, whereby it was confirmed that the resonant frequency can be adjusted independently without the impedance being substantially changed.

What is claimed is:

1. An antenna apparatus comprising:

an antenna block and a substrate upon which the antenna block is mounted, wherein the antenna block has a base that is made of a substantially cuboid dielectric body or magnetic body, an upper-surface conductor formed on an upper surface of the base, first and second pad electrodes that are formed on both ends of a bottom surface of the base in a longitudinal direction of the base, respectively, and a lateral-surface conductor connecting the upper-surface conductor and the second pad electrode; and the substrate has a region mounting the antenna block, a ground pattern provided around the mounting region, first and second lands that are provided within the mounting region so as to correspond to the positions of the first and second pad electrodes, a feed line that is connected to the first land, an impedance-adjusting pattern connecting the first land and the ground pattern, and a frequency-adjusting pattern connecting the second land and the ground pattern.

2. The antenna apparatus as claimed in claim 1, further comprising an impedance-adjusting element mounted on the substrate and connecting the feed line and the ground pattern.

3. The antenna apparatus as claimed in claim 1, wherein the antenna block further comprises a third pad electrode provided to a center part of the bottom surface of the base in the longitudinal direction, and the substrate further comprises a third land that is provided within the mounting region so as to correspond to the position of the third pad electrode.

4. The antenna apparatus as claimed in claim 3, further comprising a frequency-adjusting element mounted on the substrate and connecting the third land and the ground pattern.

5. The antenna apparatus as claimed in claim 1, comprising a plurality of the impedance-adjusting pattern.

6. The antenna apparatus as claimed in claim 5, further comprising a slit provided in the ground-pattern and extending from a space provided between the plurality of the impedance-adjusting pattern.

7. The antenna apparatus as claimed in claim 6, the antenna apparatus comprising a plurality of the slit, wherein lengths of the plurality of the slit are different from each other.

8. The antenna apparatus as claimed in claim 1, comprising a plurality of the frequency-adjusting pattern.

9. The antenna apparatus as claimed in claim 8, further comprising a slit provided in the ground-pattern and extending from a space provided between the plurality of the frequency-adjusting pattern.

10. The antenna apparatus as claimed in claim 9, the antenna apparatus comprising a plurality of the slit, wherein lengths of the plurality of the slit are different from each other.

11. A method for adjusting characteristics of an antenna apparatus, wherein the antenna apparatus comprises an antenna block and a substrate upon which the antenna block is mounted, the antenna block has a base that is made of a substantially cuboid dielectric body or magnetic body, an upper-surface conductor formed on an upper surface of the base, first and second pad electrodes that are formed on both ends of a bottom surface of the base in a longitudinal direction of the base, respectively, and a lateral-surface conductor connecting the upper-surface conductor and the second pad electrode, and the substrate has a region mounting the antenna block, a ground pattern provided around the mounting region, first and second lands that are provided within the mounting region so as to correspond to the positions of the first and second pad electrodes, a feed line that is connected to the first land, an impedance-adjusting pattern connecting the first land and the ground pattern, and a frequency-adjusting pattern connecting the second land and the ground pattern, the method comprising the steps of:

preparing the substrate on which the impedance-adjusting pattern having a prescribed shape and size is formed and mounting the antenna block on the mounting region;

measuring an impedance of the antenna block on the substrate; and selecting the impedance-adjusting element having an appropriate constant on the basis of the measurement results and mounting the impedance-adjusting element on a prescribed location on the substrate.

12. A method for adjusting characteristics of the antenna apparatus, wherein the antenna apparatus comprises an antenna block and a substrate upon which the antenna block is mounted, the antenna block has a base that is made of a substantially cuboid dielectric body or magnetic body, an upper-surface conductor formed on an upper surface of the base, first and second pad electrodes that are formed on both ends of a bottom surface of the base in a longitudinal direction of the base, respectively, and a lateral-surface conductor connecting the upper-surface conductor and the second pad electrode, and the substrate has a region mounting the antenna block, a ground pattern provided around the mounting region, first and second lands that are provided within the mounting region so as to correspond to the positions of the first and second pad electrodes, a feed line that is connected to the first land, an impedance-adjusting pattern connecting the first land and the ground pattern, and a frequency-adjusting pattern connecting the second land and the ground pattern, the method comprising the steps of:

preparing the substrate on which the frequency-adjusting pattern having a prescribed shape and size is formed and mounting the antenna block on the mounting region;

measuring a frequency of the antenna block on the substrate; and selecting the frequency-adjusting element having an appropriate constant on the basis of the measurement results and mounting the frequency-adjusting element on a prescribed location on the-substrate.

* * * * *